US005593614A

United States Patent [19]

Laitem et al.

[11] Patent Number: 5,593,614

[45] Date of Patent: Jan. 14, 1997

[54] FABRIC SOFTENING COMPOSITION BASED ON HIGHER FATTY ACID ESTER AND DISPERSANT FOR SUCH ESTER

[75] Inventors: Leopold Laitem, Lebanon, N.J.; Regis Cesar, Villers le Bouillet, Belgium

[73] Assignee: Colgate-Palmolive Company, New York, N.Y.

[21] Appl. No.: 350,394

[22] Filed: Dec. 5, 1994

Related U.S. Application Data

[63] Continuation of Ser. No. 945,715, Sep. 16, 1992, abandoned.

[51] Int. Cl.[6] ..... D06M 13/325

[52] U.S. Cl. ..... 510/524

[58] Field of Search ..... 252/8.6, 8.8, 8.9, 252/DIG. 1, 548, 174.21

[56] References Cited

U.S. PATENT DOCUMENTS

| | | | |
|---|---|---|---|
| 3,928,212 | 12/1975 | Goto et al. | 252/8.6 |
| 3,951,825 | 4/1976 | Carver | 252/8.7 |
| 4,126,562 | 11/1978 | Goffinet et al. | 252/8.8 |
| 4,142,978 | 3/1979 | Murphy | 252/8.7 |

(List continued on next page.)

FOREIGN PATENT DOCUMENTS

| | | |
|---|---|---|
| 0276999 | 8/1988 | European Pat. Off. . |
| 0494769 | 7/1992 | European Pat. Off. . |
| 2337782 | 8/1977 | France . |
| 3612479 | 10/1987 | Germany . |

(List continued on next page.)

*Primary Examiner*—Paul Lieberman
*Assistant Examiner*—Michael P. Tierney
*Attorney, Agent, or Firm*—Bernard Lieberman; Henry S. Goldfine

[57] ABSTRACT

A fabric softening product which is a composition or an article for application to fibrous materials so that a fabric softening component thereof is deposited on the fibrous materials and softens the same, the fabric softening component comprising at least one higher aliphatic acid ester selected from the group consisting of:

I. an ester having the formula:

wherein $R_1$, $R_2$, $R_3$ and $R_4$ may be the same or different and are H, $-(H_2)_xOR_5$ or $-(H_2)_yCH_3$; $R_5$ is H, $-OCR_6$, $-[-(CH_2-]_nH$ or $-[-(CH_2-)_m-O-]_nOCR_6$ and $-OCR_6$ is a higher fatty acid acyl group having 8 to 24 carbon atoms;

x is an integer from 0 to 3, y is an integer from 0 to 4, m is an integer from 1 to 3, and n is an integer from 1 to 10;

with the proviso (1) that only two of $R_1$, $R_2$, $R_3$ and $R_4$ may be H or $-(CH_2)_yCH_3$ and (2) that there be at least 2 higher fatty acid acyl groups;

II. an oligomer of I; and

III. an ester having the formula:

$$R_7-O[(CH_2)_a-O]_b-R_8$$

wherein $R_7$ and $R_6$ may be the same or different and are H or $-OCR_6$, a is an integer from 1 to 3, b is an integer from 1 to 20 and $-OCR_6$ has the meaning ascribed above;

with the proviso that only one of $R_7$ and $R_8$ may be H; and a dispersing agent therefor.

5 Claims, 2 Drawing Sheets

U.S. PATENT DOCUMENTS

| | | | |
|---|---|---|---|
| 4,155,855 | 5/1979 | Goffinet et al. | 252/8.8 |
| 4,162,984 | 7/1979 | DeBlock et al. | 252/8.8 |
| 4,209,549 | 6/1980 | Murphy | 427/11 |
| 4,214,038 | 7/1980 | McCarty et al. | 428/411 |
| 4,237,016 | 12/1980 | Rudkin et al. | 252/8.8 |
| 4,247,425 | 1/1981 | Egan et al. | 252/548 |
| 4,256,611 | 3/1981 | Egan et al. | 252/548 |
| 4,347,145 | 8/1982 | Gregorian et al. | 252/8.8 |
| 4,583,987 | 4/1986 | Kurz | 8/495 |
| 4,824,594 | 4/1989 | Hoeffkes et al. | 252/174.21 |
| 4,830,771 | 5/1989 | Ruback et al. | 252/8.6 |
| 4,911,852 | 3/1990 | Coffindaffer et al. | 252/8.8 |
| 4,965,100 | 10/1990 | Leigh et al. | 427/242 |
| 5,089,148 | 2/1992 | Van Blarcom et al. | 252/8.6 |
| 5,126,060 | 6/1992 | Puentes-Bravo et al. | 252/8.8 |
| 5,174,912 | 12/1992 | Coffindaffer et al. | 252/8.8 |
| 5,183,580 | 2/1993 | Lew et al. | 252/8.6 |
| 5,185,088 | 2/1993 | Hartman et al. | 252/8.6 |
| 5,240,743 | 8/1993 | Tuller et al. | 427/384 |
| 5,403,509 | 4/1995 | Pujol et al. | 252/174.22 |

FOREIGN PATENT DOCUMENTS

| | | |
|---|---|---|
| 57-109817 | 1/1984 | Japan . |
| 0247370 | 5/1990 | Japan . |
| 1257928 | 12/1971 | United Kingdom . |
| 2223022 | 10/1990 | United Kingdom . |
| 2230022 | 10/1990 | United Kingdom . |

FABRIC SOFTENING COMPOSITION BASED ON HIGHER FATTY ACID ESTER AND DISPERSANT FOR SUCH ESTER

This is a continuation of application Ser. No. 07/945,715 filed Sep. 16, 1992, now abandoned.

BACKGROUND OF THE INVENTION

Related Applications

This application contains subject matter related to that described in U.S. application Ser. No. 07/755,965 filed Sep. 6, 1991; Ser. No. 07/756,030 filed Sep. 6, 1991; and Ser. No. 07/638,945 filed Jan. 9, 1991.

Field of the Invention

The present invention relates to fabric softening compositions and/or articles suitable for applications to laundry during washing, rinsing and/or drying cycles.

Discussion of the Prior Art

Fabric softening compositions and articles have long been employed to make washed laundry items softer to the touch and more comfortable to the wearer. Such compositions include solutions, emulsions and particulate and powder products and such articles include paper strips that have been impregnated with fabric softener. The fabric softeners of choice for most commercial products have usually been quaternary ammonium salts such as dimethyl ditallowyl ammonium chloride and emulsions of such softener have been added to the rinse water in the washing machine to effectively soften laundry. Alternatively, such emulsions or powder products including such fabric softener can be added to the wash water with a detergent composition or the detergent composition can include a fabric softening component to make a so-called "softergent." Articles containing a fabric softening component such as a quaternary ammonium salt may be added to the automatic laundry dryer, wherein during tumbling of the laundry in a heated environment, the fabric softener is applied to the laundry by repeated contact and softens the same.

Although various fabric softening and anti-static compositions including softergents have been marketed over the years with varying degrees of commercial success, and although different fabric softening compounds have been included therein, the most successful of such compounds have been the quaternary ammonium salts. Such compounds are often of the formula

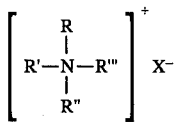

wherein R, R', R" and R"' are all alkyl groups with at least one of such alkyls being a higher alkyl and with the others being lower alkyl(s) of 1 or 2 carbon atoms, and with $X^-$ being a salt-forming anion. Preferably, such quaternary ammonium salt is a di-lower alkyl, di-higher alkyl ammonium halide, but mono-lower alkyl, tri-higher alkyl ammonium halides have also found use in some instances.

While such quaternary ammonium salts have been effective fabric softeners in the described applications, they are also characterized by disadvantageous properties which have led to attempts to find replacements therefor. For example, being cationic, they tend to react with anionic materials such as anionic synthetic organic detergent and builders for synthetic detergents, sometimes to the detriment of their intended fabric softening function. Moreover, they are not as readily biodegradable as is desirable and they have been found to be toxic to aquatic organisms which could lead to harmful effects on aquatic life in lakes, rivers and other waters into which waste waters carrying such compounds could be emptied.

In efforts to find substitutes for quaternary ammonium salts as fabric softeners, neoalkanamides, glyceryl esters, glycol esters, silicones, cationic-anionic complexes, bentonite and various lubricants have been suggested for use alone or in conjunction with reduced amounts of the quaternary ammonium salts, but frequently the softening effects thereof were insufficient or the substitute softeners possessed other characteristics which made them less desirable than the quaternary ammonium salts, despite the disadvantages of the latter.

Now, however, applicants have discovered a class of higher aliphatic fatty acid esters that can satisfactorily soften laundry essentially to the same extent as the quaternary ammonium salts, and that do not exhibit the adverse effects of the quaternary ammonium salts on aquatic organisms. This is an especially important discovery at this time when the seriousness of the problem is being recognized and when several countries are passing laws and promulgating regulations prohibiting the incorporation of some quaternary ammonium compounds in products that may be discharged into sewage and drainage systems and, ultimately, into bodies of water wherein the possibility of toxic effects on aquatic life exists.

In application Ser. No. 07/755,965 filed Sep. 6, 1991; Ser. No. 07/756,030 filed Sep. 6, 1991; and Ser. No. 07/638,945 filed Jan. 9, 1991, the entire contents and disclosures of each of which are incorporated herein by reference, there are described certain higher fatty acid esters of pentaerythritol, pentaerythritol oligomers and ethoxylated derivatives thereof which function as fabric softeners in conjunction with dispersing agents therefor.

U.S. Pat. No. 3,928,212 describes various softening agents which are polyhydric alcohol esters, but none of them is a pentaerythritol ester or an ester of an oligomer or ethoxylated derivative of pentaerythritol.

U.S. Pat. No. 4,126,562 mentions erythritol and pentaerythritol in a list of alcohols which may be reacted with higher fatty acids to produce fabric conditioning agents, but no such compound is actually described and none is shown in a fabric softening composition or article. Also, U.S. Pat. No. 4,126,562 discloses a combination of a quaternary ammonium salt fabric softener and a non-ionic ester of an alcohol with a higher fatty acid, with no teaching therein that the ester would be useful alone as a fabric softener.

U.S. Pat. No. 4,142,978 describes sorbitan esters with phase modifying components such as alkyl sulfates on a dryer sheet for softening laundry while it is being tumble-dried in an automatic laundry dryer. There is no mention in this patent of any pentaerythritol esters.

U.S. Pat. No. 4,162,984 relates to a textile treatment emulsion of a water-insoluble cationic fabric softener which is preferably a fatty acid ester of a mono- or polyhydric alcohol or an anhydride thereof and an aromatic mono- or dicarboxylic acid. Among the polyhydric alcohols that may be esterified, according to the patent, is pentaerythritol, but no pentaerythritol ester is described specifically, nor is any oligomer of pentaerythritol suggested and none is shown to be a useful fabric softening agent in the absence of quaternary ammonium salt and aromatic carboxylic acid. Although the patentees were aware of the disadvantages of the quaternary ammonium salt component (reaction with anionic detergent from the wash cycle) and found that its content could be reduced if the pentaerythritol ester and aromatic carboxylic acid were present, they never recognized and apparently never made a fabric softening composition which did not contain quaternary ammonium halide or equivalent cationic fabric softener.

U.S. Pat. No. 4,214,038 relates to polyglycerol esters as softening agents suitable for deposition on drying laundry from paper substrates charged to the laundry dryer with the laundry being dried. Although polyglycerol is a polyhydric alcohol, as is pentaerythritol, it is not the same as pentaerythritol, and the patent does not suggest the use of pentaerythritol esters as fabric softeners.

European Patent Specification No. 276999-A mentions fabric conditioning compositions containing a non-cationic fabric softener and a non-ionic cellulose ether. Although esters of polyhydric alcohols are mentioned as suitable conditioning agents, pentaerythritol esters are not disclosed therein.

German Patent Specification No. 3612479-A describes textile softening compositions containing quaternary ammonium compounds with carboxylic esters. Among the carboxylic acid esters mentioned are esters of various alcohols and polyols, including pentaerythritol. However, no such specific ester is described or even named and no softening composition which does not contain a quaternary ammonium compound as the fabric softener is disclosed.

Japanese Patent No. 90/47370 discloses fabric softening compositions based on quaternary ammonium salts which may contain higher fatty acid esters of pentaerythritol. No specific such ester is described in the abstract.

None of the disclosures mentioned hereinabove teach that any pentaerythritol ester could be employed with a suitable dispersing agent as a fabric softener in place of a quaternary ammonium compound or quat softener which would have essentially equivalent softening action, and none of the disclosures mentions any specific pentaerythritol ester, nor do any mention any ester of an oligomer of pentaerythritol, of lower alkoxylated pentaerythritol or of an oligomer thereof as a fabric softening agent in a fabric softening composition.

It is an object of the present invention to provide a fabric softening product which is a composition or an article for application to fibrous materials so that a fabric softening component which is one of a certain class of higher aliphatic acid esters is deposited on the fibrous material, which fabric softening product is not subject to the disadvantages associated with conventional quaternary ammonium salt fabric softeners.

SUMMARY OF THE INVENTION

Figure 1:
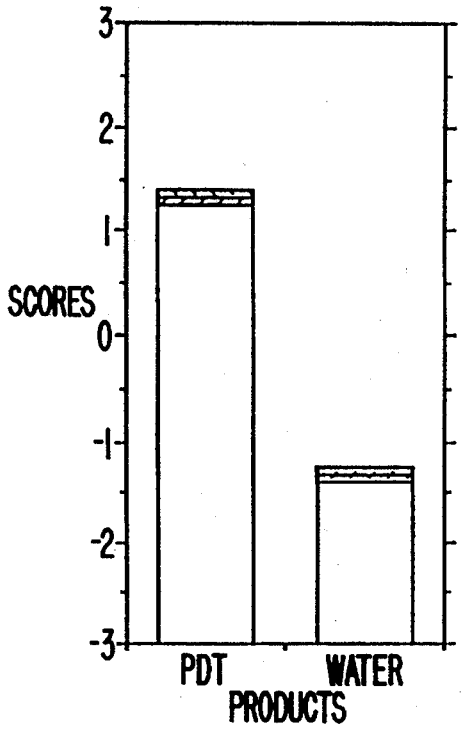
FIGS. 1–7 depict the results in bar graphical form of the fabric softening tests described in the examples hereinbelow.

These and other objects are realized by the present invention, one embodiment of which relates to a fabric softening product which is a composition or an article for application to fibrous materials so that a fabric softening component thereof is deposited on the fibrous materials and softens the same, the fabric softening component comprising at least one higher aliphatic acid ester selected from the group consisting of:

I. an ester having the formula:

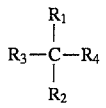

wherein $R_1$, $R_2$, $R_3$ and $R_4$ may be the same or differe and are H, $-(CH_2)_xO_5$ or $-(CH_2)_yCH_3$; $R_5$ is H, $—OCR_6$, $-[-(CH_2)_m-O-]_nH$ or $-[-(CH_2)_m-O-]_nOCR_6$ and $—OCR_6$ is a higher fatty acid acyl group having 8 to 24 carbon atoms;

x is an integer from 0 to 3, y is an integer from 0 to 4, m is an integer from 1 to 3, and n is an integer from 1 to 10;

with the proviso (1) that only two of $R_1$, $R_2$, $R_3$ and $R_4$ may be H or $(CH_2)_yCH_3$ and (2) that there be at least 2 higher fatty acid acyl groups;

II. an oligomer of I; and

III. an ester having the formula:

$$R_7—O\{(CH_2)_a-O\}_b R_8$$

wherein $R_7$ and $R_8$ may be the same or different and are H or $—OCR_6$, a is an integer from 1 to 3, b is an integer from 1 to 20 and $—OCR_6$ has the meaning ascribed above;

with the proviso that only one of $R_7$ and $R_8$ may be H; and a dispersing agent therefor.

DETAILED DESCRIPTION OF THE INVENTION

The present invention is predicated on the discovery that fabric softening products containing one or more of the above-described higher aliphatic acid esters provide a degree of fabric softening to fibrous materials to which they are applied which can be equivalent to products containing the conventionally employed quats without the disadvantages attendant the latter.

The higher aliphatic or fatty acids that may be employed as esterifying acids are those of carbon atom contents in the range of 8 to 24, preferably 12 to 22, and more preferably 12 to 18, e.g., lauric, myristic, palmitic, oleic, stearic and behenic acids, etc. They may be mixtures of such fatty acids obtained from natural sources such as coco fatty acid, commercial stearic acid, tallow acid or hydrogenated tallow acid. Intermediate synthetic acids of odd or even numbers of carbon atoms may also be employed.

The alcohol moiety of the higher aliphatic acid esters [identified as (I) above] of the fabric softening products of the invention may be broadly defined as aliphatic polyhydric alcohols containing from 2 to 30 carbon atoms and from 2 to 6 hydroxyl groups.

The oligomers of the polyhydric alcohols which may be esterified to form the fabric softeners [identified as (II) above] of the products of the invention are preferably those of 2 to 20 polyhydric alcohol moieties, and more preferably 2 to 12, with such moieties being joined together through single etheric bonds.

The alkylene glycol moieties of the polyhydric alcohols which may be esterified to form the fabric softeners [identified as III above] of the products of the invention are preferably lower alkylene oxide monomers, dimers or polymers which terminate in hydroxyls. The alkylene oxide may contain from 1 to 4, and preferably 2 to 3, carbon atoms, and the polymer ester may contain as many as 20, and preferably from 1 to 10, alkylene oxide moieties.

The higher fatty acid esters of the above-described polyhydric alcohols may be partial esters.

Exemplary of suitable higher aliphatic fatty acid esters for use as fabric softening agents in the product of the invention are the following:

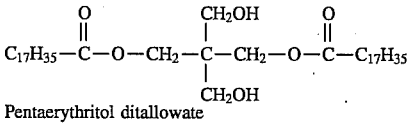

Pentaerythritol ditallowate

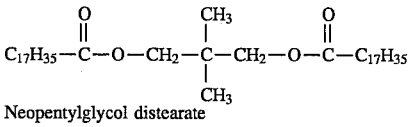

Neopentylglycol distearate

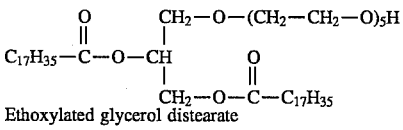

Ethoxylated glycerol distearate

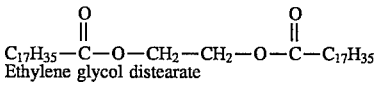

Ethylene glycol distearate

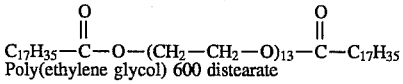

Poly(ethylene glycol) 600 distearate

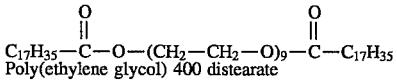

Poly(ethylene glycol) 400 distearate

Mixtures of the above-described esters may also advantageously be employed as the fabric softening agent in the products and processes of the invention. Those skilled in the art, based upon the teachings and disclosures herein, would have no difficulty in formulating such mixtures for inclusion in the compositions and methods of the invention.

A preferred class of esters is that having the formula:

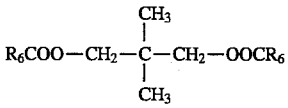

wherein $OCR_6$ has the meaning ascribed above.

A most preferred member of this class of esters is that wherein $CR_6$ is $C_{17}H_{35}$.

Another preferred class of esters is that of the formula:

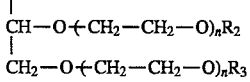

wherein $R_1$, $R_2$, $R_3$ and n have the meanings ascribed above.

A most preferred member of this class of esters is that wherein $R_1$ is H, $R_2$ and $R_3$ are $OCR_6$, $R_6$ being most preferably $C_{17}H_{35}$, and the total of n is 5.

Still another preferred class of esters is that of the formula:

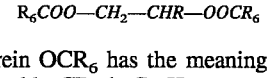

wherein $OCR_6$ has the meaning ascribed above, and most preferably $CR_6$ is $C_{17}H_{35}$.

Yet another preferred class of esters is that of the formula:

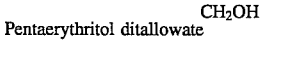

wherein $OCR_6$ and b have the meanings ascribed above, and most preferably $CR_6$ is $C_{17}H_{35}$ and b is 13.

In this specification, when reference is made to a compound of a class, unless it is indicated otherwise therein, it is to be considered that the employment of mixtures of compounds of such class are included (commercial compounds are often mixtures).

The esters utilized in this invention have some fabric softening effects, but such activities are remarkably increased when a suitable dispersing agent for the ester is present therein. In the absence of such an agent, the ester may be substantially insoluble and undispersed in wash water or in rinse water in which, if dispersed, it could be conveniently applied to laundry to be softened. When undispersed, the ester could be in solid agglomerate form when cold or in molten form when hot, in neither of which states does it act effectively to soften fabrics (and in both of which cases, it can deposit objectionably on treated materials to produce greasy spotting thereof).

Suitable dispersing agents include emulsifiers, usually employed to "solubilize" or disperse the ester in aqueous liquid compositions that are intended to be employed as rinse cycle softeners (although they may also be added to the wash water), and solids of small (often micron size) ultimate particle sizes such as clays which may be present in particulate and other solid products, as well as in liquid products.

The emulsions [which term herein is also intended to encompass dispersions and suspensions in liquid media, as well as microemulsions (and sometimes solutions may also be present in which solvents are the "dispersing agents")] of this invention will normally be aqueous emulsions in which the aqueous phase is the continuous phase, with the ester being in the dispersed phase. However, solvents and co-solvents such as ethanol, isopropanol, propylene glycol and various mono- and di-lower alkyl esters of diethylene glycol (Carbitols®) may also be present in such emulsions and microemulsions to promote formation of stable products and may also be in the continuous media or solutions.

Various emulsifiers can be employed and many such emulsifiers are described in the annual editions of *Detergents and Emulsifiers* published by John W. McCutcheon, particularly those editions published in 1969, 1973, 1980 and 1981. Preferred such emulsifiers are those which are alkyl ethers or amines which also contain one or more hydroxyalkyl substituents. Of these, the more preferred are the alkyl dialkanolamines or alkyl trialkanolpropylene diamines wherein the alkanol moieties are of 2 to 4 carbon atoms, preferably 2 to 3, and more preferably 2, and the alkyl poly(ethylene oxide) ethers are of 2 to 24 ethylene oxide units, preferably of 8 to 12 ethylene oxide units in which emulsifiers the alkyl is of 8 to 24, and preferably 12 to 18, carbon atoms. More preferred such emulsifiers are: stearyl diethanolamine, available from Hoechst A. G. as Genamin® S-020; tallow triethanol propylene diamine, available from CECA, S. A. as Dinoramox® S3; and R-O-$(CH_2CH_2O)_{10}$H, wherein R is a mixture of $C_{12-15}$ alkyls, available from Hoechst A. G. as Genapol® OX-100.

When it is desired in the practice of the present invention that the dispersing agent for the active ester softening agent be in particulate or powder form rather than emulsion form, any suitable particulate or powder material that is compatible with the mentioned softening agent may be employed, but it may often be preferred to utilize a material that can contribute some fabric softening action to the composition. For example, bentonite and other fabric softening clays and clay-like materials may be substituted therefor, at least in part. Also, other non-functional, substantially water-insoluble, dispersing agents may be utilized, e.g., calcium carbonate and silica may be carriers for the ester. Even water-soluble carriers such as sodium sulfate and other "filler salts" may be used at least in part with the dispersing agent, and sometimes can act as dispersing agents as well. The bentonite employed should preferably be of a type which is gel-forming in water and is capable of softening fibrous materials and should be of micron range ultimate particle size, although it may be agglomerated to larger sizes, usually in the range of 8 to 140 sieves, U.S. Sieve Series. If desired, an emulsifier may be utilized in the particulate or solid compositions, and bentonite or other dispersing clay may be present in the emulsions or dispersions, or other swelling clays may be employed.

When the ester softening agent is to be applied to laundry being dried in a laundry dryer such as an automatic clothes dryer, the ester or mixture thereof may be applied to a substrate material from which it may be transferred to the drying laundry under the influence of the heat in the drying air and the rubbing action of the substrate against the tumbling laundry. The substrate used may be paper or other fibrous material, sponge, preferably cellulose or polyurethane, or other suitable base material with the ester being such that it is solid at room temperature and liquefiable and/or softenable at dryer temperatures. The ester may be blended with other suitable waxy-type material, plasticizer or hardener to control the softening point thereof when desirable.

Normally, in the various applications mentioned, the ester will be employed in the absence of any other fabric softening material (except clay such as bentonite, montmorillonite or other smectite), but it is possible to utilize such other materials with the ester if, in the proportions and quantities employed, they are not ecologically unacceptable and if they do not interfere with the fiber softening action of the ester. In fact, sometimes when anti-static properties are desirable in the product, such additions may be important because, although the esters have some anti-static action, it is occasionally insufficient for the intended purposes. Thus, it is possible to formulate fabric softening compositions and articles with the ester supplemented by other anti-static agents and also by fabric softeners. The foremost of such anti-static materials are the quaternary ammonium salts, but when they are present, there can be ecological problems due to their toxicities to aquatic organisms. For example, in standard toxicity tests against daphnia, the concentration for 50% effect is less than 1 mg/l for ditallowalkyl dimethyl ammonium chloride, which is environmentally unacceptable. Other anti-static and fabric softening agents include higher alkyl neoalkanamides, e.g., N-stearyl neodecanamide; isostearamides; amines such as N,N-ditallowalkyl N-methyl amine; esterified quaternary salts or esterquats; amidoamines; amidoquats; imidazolines; imidazolinium salts; di-higher fatty acid esters of di-lower alkanolamines such as dicoco acid ester of diethanolamine; silicones; alkoxylated silicones; and clays, e.g., bentonites and other montmorillonites. Representative examples of some classes of such compounds are set forth below.

Quat

-continued

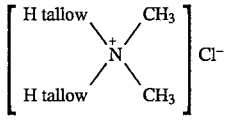

Esterquat

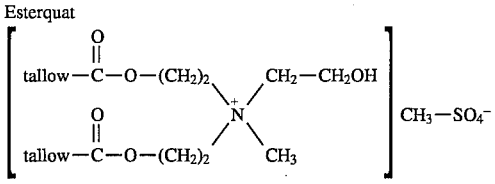

Amido amine

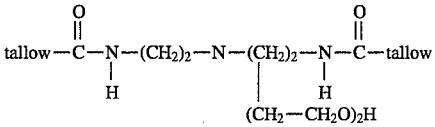

Amido quat

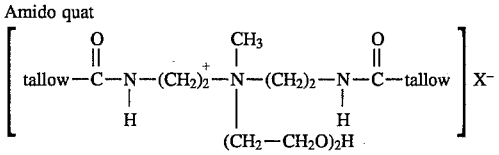

Imidazoline

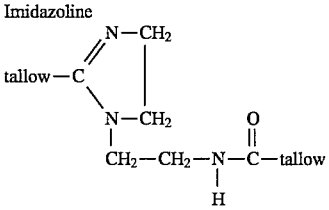

Imidazolinium Salt

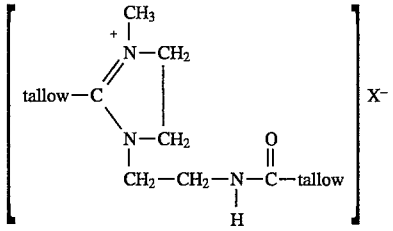

Silicone: Polydimethylsiloxane

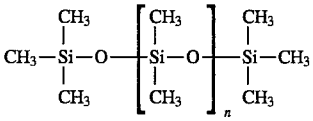

Cl ay: Bentonite

It should be kept in mind that when employing supplementary anti-static and fabric softening agents, they should not make the compositions in which they are incorporated of greater ecotoxicity than is allowable by law and by regulatory authorities in the area of intended use. Thus, ditallowalkyl dimethyl ammonium chloride will usually be avoided, as will compounds that have similar adverse effects on aquatic organisms, or the amounts thereof present will be limited so as to avoid such undesirable effects.

Other materials that may be incorporated in the compositions of the present invention include the usual adjuvants that normally are present in other fabric softening compositions (including softergents) such as perfumes, fixatives, solvents, co-solvents, hydrotropes, anti-oxidants, stabilizers, pH adjusters, buffers, biodegradable anti-microbials, builders, fillers, enzymes, thickeners and fluorescent brighteners, all of which are known classes of materials in the fabric softening compositions field, with examples of several of these set forth in the prior art mentioned hereinabove, all of which are hereby incorporated herein by reference.

The final component of the present compositions required in the aqueous emulsions is water. Normally, any clean water having a hardness in the range of 0 to 500 ppm, i.e., $CaCO_3$, may be employed, but it is preferred to use water having a hardness of no more than 150 ppm, more preferably less than 50 ppm, and most preferably the water will be deionized water that has been irradiated.

Although the foregoing description is primarily directed to fabric softening compositions for addition to wash or rinse waters, especially during automatic washing processes, the invention also includes detergent compositions (softergents) containing the described ester and a suitable dispersing agent. Such detergent compositions will contain at least one synthetic organic detergent, preferably of the anionic or non-ionic type (or a mixture thereof), which may act as a dispersing agent for the ester.

The anionic detergents are normally of the water-soluble sulfated and/or sulfonated lipophile type which may be designated "sulf(on)ated," and which includes lipophilic and sulf(on)ate moieties, but analogous phosph(on)ates may also be utilized. Of the synthetic anionic organic sulf(on)ated detergents, those preferred are higher alkyl (preferably linear alkyl) benzene sulfonates, higher fatty alcohol sulfates, higher fatty alcohol ethoxylate sulfates, olefin sulfonates and paraffin sulfonates. Usually such compounds are water-soluble alkali metal salts, such as sodium salts, and include higher fatty alkyl or other aliphatic moieties which serve as lipophilic moieties and which increase detergency, especially against greasy soils. Such higher alkyl or higher aliphatic moieties will normally be of 8 to 22 carbon atoms, preferably 10 or 12 to 16 or 18 carbon atoms and, more preferably, especially for the alkyl sulfates and alkylbenzene sulfonates, the alkyl moieties will be of 12 to 14 carbon atoms. The higher fatty alcohol ethoxylate sulfates that are useful will normally be of 1 to 20 ethoxy groups per mol, and preferably 3 to 10 or 15, e.g., 3 or 7. As representatives of such detergents, there may be mentioned sodium linear dodecylbenzene sulfonate, sodium linear tridecylbenzene sulfonate, sodium lauryl alcohol sulfate, sodium coco alcohol triethoxylate sulfate, sodium $C_{16}$ paraffin sulfonate and sodium olefin sulfonate derived from $C_{14}$ olefin.

Among the non-ionic detergents, those which are most preferred are ethylene oxide condensates with higher fatty alcohols or with alkyl phenols such as condensation products of 3 to 20, 5 to 15, 6 to 12, or 7 to 11 mols of ethylene oxide with higher fatty alcohols of 10 or 12 to 18 or 13 to 17 carbon atoms or with alkyl phenols of 7 to 10 carbon atoms in the alkyl groups, e.g., Dobanol® 25-7, Synperonic® A7, Neodol® 25-3, Neodol® 25-7, Neodol® 45-11, and $C_{13-17}$ alcohols condensed with 7 or 11 mols of ethylene oxide per mol. Although the improved softening obtained when a dispersing such as bentonite is employed with an ester is noticeable in anionic detergent compositions, such softening action is increased even more when the detergent composition contains a non-ionic detergent with the anionic detergent or in lieu thereof because the non-ionic detergent ester is inactive.

In addition to the above examples of suitable anionic and non-ionic detergents, extensive listings of such detergents useful in the practice of the present invention may be found in standard textbooks relating to synthetic organic detergents such as the McCutcheon texts, supra.

Of the water-soluble builders for such detergents, it is preferred to employ water-soluble salts such as sodium or potassium salts, and more preferably sodium salts. Of these, the carbonates, silicates, borates, bicarbonates and phosphates, and more preferably polyphosphates, are preferred, such as sodium carbonate, sodium bicarbonate, sodium silicate of $Na_2O:SiO_2$ ratio in the range of 1:1.6 to 1:3, and preferably 1:2 to 1:3, e.g., about 1:2, 1:2.35 or 1:2.4, sodium tripolyphosphate and tetrasodium pyrophosphate, but sodium sesquicarbonate and sodium sesquisilicate may also be used, as well as the corresponding potassium and other soluble salts, when suitable. Of the water-insoluble builders, which builders also have water softening properties, the most preferred are the zeolites, especially the hydrated zeolites. Such zeolites include crystalline, amorphous and mixed crystalline and amorphous zeolites of both synthetic and natural origins, which are of satisfactorily quick and sufficiently effective activities in counteracting calcium hardness ions in wash waters. Preferably, the zeolites employed are characterized as having high exchange capacities for calcium ions, which exchange capacity is normally from about 200 to 400 milligram equivalents of calcium carbonate per gram of the zeolite. Although other ion exchanging zeolites may also be utilized, often the zeolite will be of the formula $$(Na_2O)_x \cdot (Al_2O_3)_y \cdot (SiO_n)_z \cdot w\ H_2O,$$

wherein x is 1, y is from 0.8 to 1.2, z is from 1.3 to 3.5 and w is from 0 to 9 and preferably is 2.5 to 6. Of the crystalline zeolites useful in the practice of the present invention, those preferred include zeolites A, X and Y, with A being more preferable and the most preferred of these being zeolite 4A. These zeolites are preferably in a finely divided state when added to the crutcher with the synthetic detergent prior to drying and are of ultimate particle diameters in the micron range, e.g., 0.01 to 20 microns, and actual particle sizes in the range of 100 to 400 sieves and preferably 140 to 325 sieves, U.S. Sieve Series. Other builders that may be utilized include organic compounds which are often sequestrants for hardness ions. Such compounds include organic acids, especially hydroxy acids and amino acids such as citric and gluconic acids, usually as their water-soluble sodium salts, and ethylene diamine tetraacetic acid (EDTA) and nitrilotriacetic acid (NTA), also usually as their water-soluble salts, e.g., sodium salts. Although sodium salts are preferred, other acceptable water-soluble salts of the organic builder acids may also be utilized. Additional useful builders are the organo-phosphorus chelating agents such as the Dequests®, e.g., Dequest 2046, manufactured by Monsanto Company.

The proportions of components of the invented compositions and article will be those which result in stable and effective products for fabric softening applications. For the esters, the concentration in such compositions and articles will normally be in the range of about 1 to 30%, preferably 1 to 12%, more preferably 2 to 8% and most preferably 3 to 7%, e.g., about 5%, especially for the rinse cycle and wash cycle additive emulsions, although for the articles percentages in the 10 to 20% range may often be preferred depending on the type and density of the substrate material (and sometimes for the softergents such a range may also be feasible). For the emulsions, the content(s) of emulsifier(s) will normally be in the range of 0.2 to 10%, preferably 0.5 to 5% and more preferably 1 to 3%, e.g., about 2 or 3%. When the emulsifier is made from an alkyl alkanolamine and an alkyl poly(ethylene oxide) ether, the proportion of the alkanolamine will desirably be equal to or greater than that of the alkyl poly(ethylene oxide) ether, preferably being 2 to 5 times as much, e.g., about 4 times as much. Thus, such percentages can be of 0.2 to 5% of the amine compound and 0 to 5% of the ether compound, preferably 0.3 to 3% and 0.1 to 2% and more preferably 0.5 to 2% and 0.2 to 1%, respectively. For example, in the composition of the working example, the percentages of such emulsifiers may be 1% of the amine compound and 0.25% of the ether compound. The aqueous medium or water content of such compositions may be the balance thereof, which will usually be in the range of 60 to 98.8%, preferably 85 to 98.5%, more preferably 87 to 97.5% and most preferably 90 to 96%, e.g., about 93%. It is to be understood that the presence of any adjuvants or supplemental components of the emulsions will be compensated for by corresponding decreases in the water content of the compositions. Usually, the total adjuvants content will be no more than 25%, preferably no more than 15% and, in many instances, will be held to a limit of 5%. None of the adjuvants, in the amounts employed, will be such as to cause unacceptable levels of toxicity which could adversely affect aquatic organisms, including fish, inhabiting lakes and streams into which are fed washing machine rinses included in the present compositions. Thus, the compositions of the present invention may be considered to consist essentially of the named components in additive or softergent form with only environmentally acceptable proportions of adjuvants being present therein. As previously mentioned, the present compositions and articles are preferably essentially free of quaternary ammonium compounds. More preferably, 0% of such compounds are present, but when the resulting compositions and articles are not ecotoxic, increasing limits of 0.1%, 0.3% and 0.5% may be imposed which are more preferred, preferred and acceptable limits, respectively, under such circumstances and can be within the boundaries of the present invention.

One suitable adjuvant is an acidifying agent such as hydrochloric acid which is useful to adjust the pH of the emulsion or other aqueous composition to 2.5 to 5.5, and preferably 2.5 to 4, e.g., 3.5. To accomplish this objective, the percentage of HCl (concentrated basis) or other equivalent acidifying agent present will usually be in the range of 0.01 to 0.4%, and preferably 0.05 to 0.2%.

When particulate or powder compositions or dryer articles are produced, the percentages of esters may be in the same ranges as provided in the preceding paragraph, or at least within the wider of such ranges, but the powder carrier/dispersing agent or the substrate for the articles may be the balance of the composition previously identified for the emulsions and, of course, suitable adjuvants may also be present. Thus, the fabric softening powders or particulate compositions may comprise 1 to 30% of ester and 70 to 99% of carrier clay such as bentonite, preferably comprise 1 to 10% of the ester and 90 to 99% of the carrier, and more preferably comprise 3 to 7% of ester and 93 to 97% of bentonite. The fabric softening article may comprise about 1 to 30% of ester with the balance being substrate material, or the percentage of ester may be in the range of 5 to 20% or 10 to 20%.

The percentages of ester and dispersing agent in softergents may be similar to those indicated hereinabove for the corresponding liquid and particulate or solid products with the proportions of water and carrier being adjusted respectively to compensate for the detergent(s), builder(s) and adjuvant(s) present. Normally, such proportions comprise 3 to 25% detergent, 10 to 60% builder, and 2 to 75% other adjuvants for the particulate or solid softergents, and preferably 5 to 20%, 20 to 50% and 2 to 60%, respectively. For the liquid softergents, detergent is present in an amount of 3 to 60%, builder comprises 5 to 50% and other adjuvants are present in the amount of 0.1 to 20%, and preferably 10 to 50%, 10 to 30% and 0.5 to 15%, respectively, with the balance being water or essentially water. The percentages of ester and dispersant are normally in the ranges of 2 to 15% and 10 to 25%, and preferably 4 to 10% and 12 to 20% for the solids and 1 to 10% and 1 to 20% for the liquids, respectively.

To manufacture the compositions and articles of the present invention is comparatively simple, but in order to produce the desired stable emulsions (and microemulsions), a particular process is desirably followed. In such cases, it is preferable that the ester be melted prior to addition to the aqueous medium and the temperature to which the ester is raised will desirably be within 10° C. of the melting point thereof. It is preferred that the ester be mixed with any meltable emulsifier, especially one of lipophilic character (or more lipophilic character than another emulsifier present) such as the amine when a mixed amine-monoether or -ethoxylated alcohol emulsifier is employed and melted therewith, but alternatively, the two meltable materials (ester and amine) may be separately melted and added together or simultaneously to the aqueous medium (usually water) which should also be at about the same elevated temperature, e.g., about 60° C. The water employed is often desirably acidified by addition of HCl or other suitable acid thereto, to generate a final pH in the range of 2.5 to 5.5, and preferably 2.5 to 4.0, e.g., about 3.5. After emulsification, the emulsion produced may be cooled to room temperature with the balance of emulsifier (monoether or ethoxylated alcohol emulsifier, in many cases) being added before or after such cooling, and preferably before. The result is a stable emulsion which resists separation under normal elevated temperature conditions for periods of six months or more.

To manufacture the particulate or powdered product, it is only required for the ester to be mixed with the dispersing material. Preferably, the melted ester at elevated temperature will be sprayed onto a tumbling mass of the particulate agglomerated smectite or montmorillonite powder such as bentonite or other disperser/carrier, and will thereby be evenly distributed throughout the material. Occasionally, the mixer employed may include size reduction means to make sure that the ester is in small enough particles so as to promote even deposition on the laundry being treated. The bentonite or other disperser particles may be at room temperature when the ester is being applied thereto, and the ester will be solidified on contact with the particulate mass, usually with little agglomeration occurring; however, by controlling the ester application, temperature and mixer speed, some agglomeration may be obtainable, if or when desired.

To make the softening article, it is usually desirable for the substrate material, in a continuous strip, to be passed through a melt, emulsion or other bath of ester (with or without disperser) with any excess being removed by a doctor blade or squeeze rolls. After cooling or drying, the strip containing the ester may be cut into individual pieces and will be ready for use.

The softergents may be made in the usual manner with the ester and disperser being post-added or being added at a suitable stage in the manufacturing process, taking into account that they will not be subjected to destabilizing or destructive temperatures.

In use, the compositions and articles of the present invention are employed in the same manner as other emulsions, powders, articles and softergents that apply fabric softener to laundry. The emulsion, powder and particulate compositions may be added to rinse water, with the concentrations of ester being in the range of about 0.001 to 0.005% of the rinse water. Alternatively, such compositions may be added to the wash water; however, in such cases, the concentrations may be increased, often about 1 to 3 times. Dryer treatment articles may be used in the same manner as products currently being marketed for such purpose, with paper strips (or towels) or equivalent sponges being added to the dryer, usually with a sheet or strip of 300 to 800 $cm^2$ being employed. Softergents may be charged to the washing machine in the same manner as detergents, with the desired concentrations being in the range of 0.25 to 1.2%, and preferably 0.5 to 1%, e.g., about 0.3% in the United States of America and about 0.8% in Europe, to compensate for different washing conditions employed.

The following examples are illustrative, but not limitative, of the present invention. Unless otherwise specified, all parts and percentages set forth herein are by weight and all temperatures are in °C.

The following formulation and testing procedures were employed to prepare and test the compositions and results described in the examples hereinafter.

FORMULATION PROCEDURE

A stable emulsion is made of the formulations described in the following examples by heating together the ester, Dinoramox® S3 (tallow propylene diamine 3 EO) and perfume to 60° C. and then admixing the melted mixture with 60° C. acidified water containing dye. (Where employed, Genapol® OX-100 is added to the aqueous phase before the addition of the melted mixture.) All of the resulting stable acidic emulsions, which are at a pH of about 3.5, are good fabric softening compositions.

TESTING PROCEDURE

In the described tests, the terrycloth employed is hardened by six treatments with an aqueous hardening composition including sodium silicate, sodium sulfate and sodium tripolyphosphate. Such hardening is effected to simulate hardening effects on material encountered in normal laundry operations and to accentuate differences between softening agents employed, and has been found to do so consistently.

When comparing two fabric softening compositions for softening action, nine tests are run on each composition using 40 cm×40 cm hardened terrycloth swatches and rinsing each of them in rinse waters containing either of the fabric softening compositions (or tap water, used as a reference). Evaluation of softening actions (or softness of the treated swatches) are made by six judges in blind comparison tests. These tests are carried out using a specially designed reduced scale rinsing apparatus. The rinsings are made in tap water (water hardness about 300 ppm $CaCO_3$) containing 0.44% by weight of the softening composition; the volume of rinse is 833 ml per 100 g of dry terrycloth. After rinsing, the swatches are air-dried in a temperature- and humidity-controlled room while being maintained horizontal to prevent loss of the fabric softener from the fabric due to dripping. After drying, the swatches are ready for softness evaluation by the judges.

The judges rate the swatches for softness by comparing them to a standard which, in the present case, is a swatch treated with tap water. The judges' ratings are evaluated using statistical techniques and the final results (displayed in a graphic format in FIGS. 1–7) show whether the softening compositions are equal in softening actions or whether one or the other is significantly better. In the bar graphs, the central value is the arithmetic mean of the scores. The rectangle represents the confidence interval of this mean (i.e., the zone where there are 95 chances out of 100 to find the correct mean). When there is no overlap of these rectangles between the two products (as in the seven examples herein), it can be said that the two products are significantly different.

EXAMPLE 1

| Component | % by weight |
|---|---|
| Pentaerythritol distearate (PDT) | 5.00 |
| Dinoramox ® S3 | 1.00 |
| Genapol ® OX-100* | 0.25 |
| Hydrochloric acid | 0.135 |
| Perfume | 0.32 |
| Blue colorant | 0.005 |
| Deionized water | 93.29 |
| TOTAL | 100.00 |

*$C_{12}C_{15}$ Alcohol 10 EO

The softening test results are depicted in FIG. 1.

EXAMPLE 2

| Component | % by weight |
|---|---|
| Neopentylglycol distearate (NPG-DS) | 5.00 |
| Dinoramox ® S3 | 1.00 |
| Hydrochloric acid | 0.135 |
| Perfume | 0.32 |
| Blue colorant | 0.005 |
| Deionized water | 93.54 |
| TOTAL | 100.00 |

Figure 2:
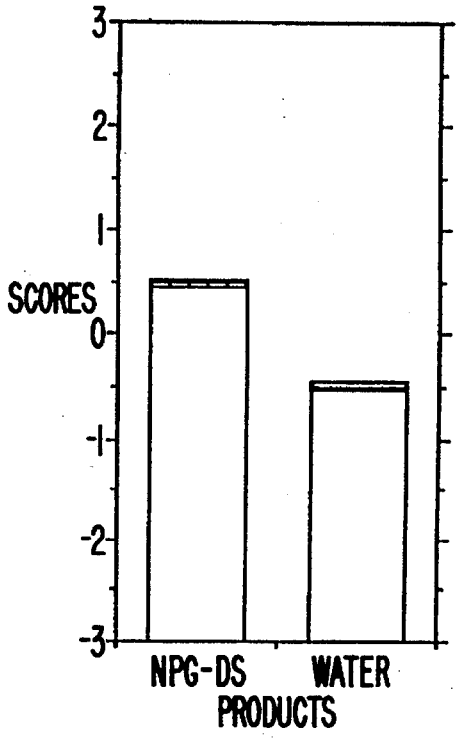

The softening test results are depicted in FIG. 2.

EXAMPLE 3

| Component | % by weight |
|---|---|
| Ethoxylated glycerol distearate (G-EO-DS) | 5.00 |
| Dinoramox ® S3 | 1.00 |
| Hydrochloric acid | 0.135 |
| Perfume | 0.32 |
| Blue colorant | 0.005 |
| Deionized water | 93.54 |
| TOTAL | 100.00 |

Figure 3:
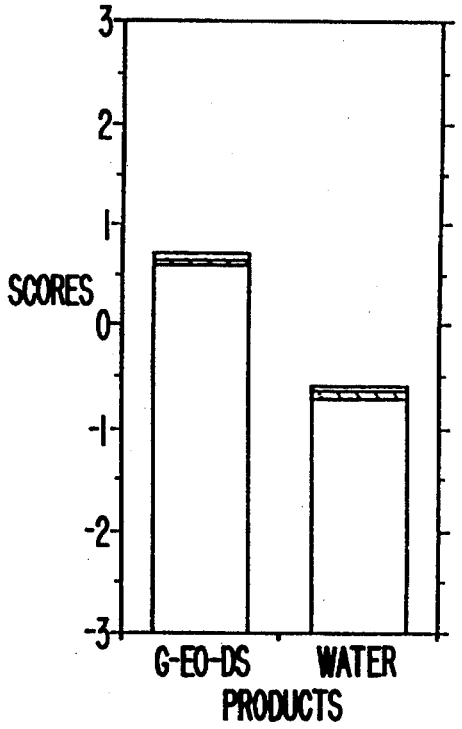

The softening test results are depicted in FIG. 3.

EXAMPLE 4

| Component | % by weight |
|---|---|
| Ethylene glycol distearate (EG-DS) | 5.00 |
| Dinoramox ® S3 | 1.00 |
| Hydrochloric acid | 0.135 |
| Perfume | 0.32 |
| Blue colorant | 0.005 |
| Deionized water | 93.54 |
| TOTAL | 100.00 |

Figure 4:
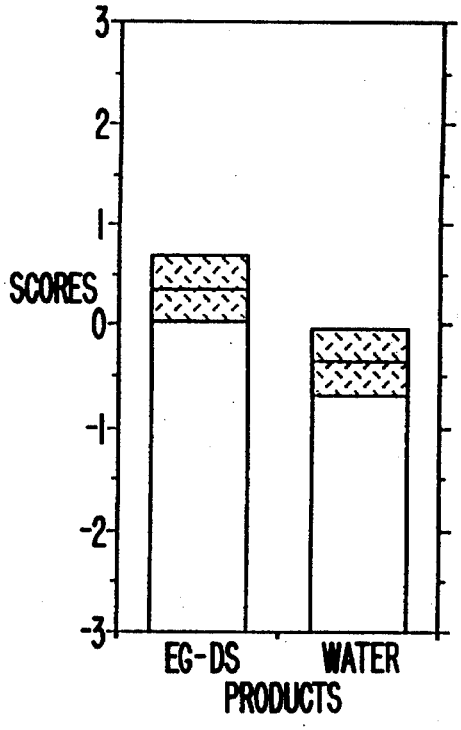

The softening test results are depicted in FIG. 4.

EXAMPLE 5

| Component | % by weight |
|---|---|
| Poly(ethylene glycol) 400 distearate (PEG400-DS) | 5.00 |
| Dinoramox ® S3 | 1.00 |
| Hydrochloric acid | 0.135 |
| Perfume | 0.32 |
| Blue colorant | 0.005 |
| Deionized water | 93.54 |
| TOTAL | 100.00 |

Figure 5:
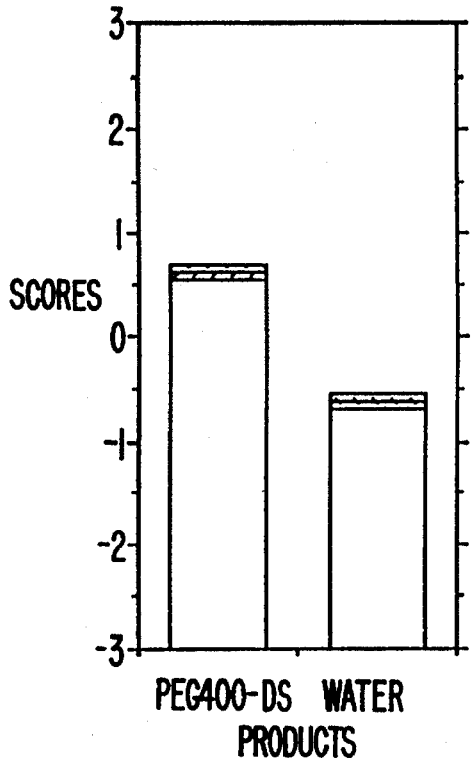

The softening test results are depicted in FIG. 5.

EXAMPLE 6

| Component | % by weight |
|---|---|
| Poly(ethylene glycol) 600 distearate (PEG600-DS) | 5.00 |
| Dinoramox ® S3 | 1.00 |
| Hydrochloric acid | 0.135 |
| Perfume | 0.32 |
| Blue colorant | 0.005 |
| Deionized water | 93.54 |
| TOTAL | 100.00 |

Figure 6:
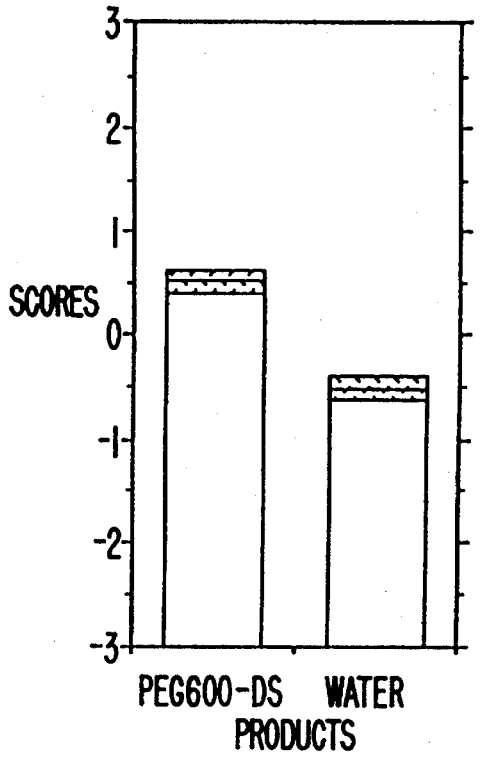

The softening test results are depicted in FIG. 6.

EXAMPLE 7

| Component | % by weight |
|---|---|
| Mixture 1:1/glycerol:ethylene glycol partial esters (MIX ESTERS) | 5.00 |
| Dinoramox ® S3 | 1.00 |
| Hydrochloric acid | 0.135 |
| Perfume | 0.32 |
| Blue colorant | 0.005 |
| Deionized water | 93.54 |
| TOTAL | 100.00 |

Figure 7:
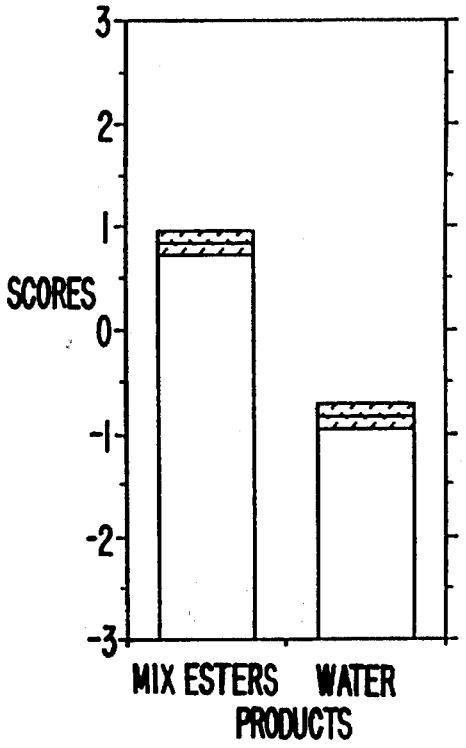

The softening test results are depicted in FIG. 7.

We claim:

1. A fabric softening product comprising from about 1 to about 30%, by weight, of the formula:

$$\begin{array}{l} CH_2-O\text{-}(CH_2-CH_2-O)_nR_1 \\ | \\ CH-O\text{-}(CH_2-CH_2-O)_nR_2 \\ | \\ CH_2-O\text{-}(CH_2-CH_2-O)_nR_3 \end{array}$$

wherein $R_1$, $R_2$, and $R_3$ may be the same or different and are H, $(CH_2)_xOR_5$ or $(CH_2)_yCH_3$:$R_5$ is H, $-OCR_6$, $\{(CH_2)_mO\}_nH$ or $\{(CH_2)_mO\}_nOCR_6$ and $-OCR_6$ is a higher fatty acid acyl group having 8 to 24 carbon atoms;

x is an integer from 0 to 3, y is an integer front 0 to 4, m is an integer from 1 to 3, and n is an integer from 1 to 10:

with the proviso (1) that only one of $R_1$, $R_2$, and $R_3$ may be H or $(CH_2)_yCH_3$ and (2) that there be a mixture of mono-, di-, and tri-esters;

from about 0.2 to about 10%, by weight, of a dispersant selected from the group consisting of C8-C24 alkyl dialkanolamine or C8-C24 alkyl trialkanolpropylene diamines; and the balance being water.

2. A fabric softening product according to claim 1 wherein $CR_6$ is $C_{17}H_{35}$ and n is 5.

3. A liquid fabric softening product according to claim 1, wherein the dispersant is selected from the group consisting of alkyl dialkanolamines or alkyl trialkanolpropylene diamines, wherein the alkanol moieties are of 2 to 4 carbon atoms.

4. A process for softening washed laundry which comprises applying to such laundry a fabric softening product of claim 1 in such a manner and under such conditions that a fabric softening component thereof is deposited on the laundry and softens the same.

5. A process according to claim 4 wherein the fabric softening product is a dryer article that is applied to the laundry and is an absorbent fibrous or cellular material which has had deposited thereon or absorbed thereby about 1 to 30% fabric softening product, on a fabric softening article basis, which is added to washed and rinsed laundry in an automatic laundry dryer, wherein the fabric softening component is transferred, at least in part, to the laundry being dried, and softens the same.

* * * * *